US009011124B2

(12) United States Patent
Cadeddu

(10) Patent No.: US 9,011,124 B2
(45) Date of Patent: Apr. 21, 2015

(54) POSITIVE DISPLACEMENT FLUID MACHINE HAVING A PIVOT SINGLE VANE PASSING THROUGH AN ORBITING PISTON

(75) Inventor: Leonardo Cadeddu, Offanengo (IT)

(73) Assignee: VHIT S.p.A., Offanengo (CR) (IT)

( * ) Notice: Subject to any disclaimer, the term of this patent is extended or adjusted under 35 U.S.C. 154(b) by 562 days.

(21) Appl. No.: 13/496,444

(22) PCT Filed: Sep. 9, 2010

(86) PCT No.: PCT/IB2010/054061

§ 371 (c)(1),
(2), (4) Date: Mar. 15, 2012

(87) PCT Pub. No.: WO2011/033426

PCT Pub. Date: Mar. 24, 2011

(65) Prior Publication Data

US 2012/0177519 A1 Jul. 12, 2012

(30) Foreign Application Priority Data

Sep. 16, 2009 (IT) ..... TO2009A0705

(51) Int. Cl.
*F01C 1/10* (2006.01)
*F03C 2/00* (2006.01)
(Continued)

(52) U.S. Cl.
CPC . *F04C 2/46* (2013.01); *F04C 2/332* (2013.01); *F04C 11/001* (2013.01); *F04C 15/06* (2013.01); *F04C 2240/20* (2013.01); *F04C 2240/30* (2013.01); *F04C 2240/40* (2013.01); *F04C 2270/13* (2013.01)

(58) Field of Classification Search
USPC ..... 418/15, 30, 62, 64, 67, 233, 253–255, 418/262, 270, DIG. 1; 417/310
See application file for complete search history.

(56) References Cited

U.S. PATENT DOCUMENTS 236,173 A * 1/1881 Mellor ..... 418/64
325,361 A * 9/1885 Rowbotham ..... 418/255
(Continued)

FOREIGN PATENT DOCUMENTS

DE 27 05 239 B1 8/1978
DE 28 51 131 A1 6/1980
(Continued)

OTHER PUBLICATIONS

International Search Report of PCT/IB2010/054061 dated Oct. 27, 2011.

*Primary Examiner* — Theresa Trieu
(74) *Attorney, Agent, or Firm* — Sughrue Mion, PLLC

(57) ABSTRACT

An enclosed positive displacement mechanism including a body with an inlet and an outlet; a rotor mounted in the body and rotatable about a main axis; an orbiting piston located in the cavity, rotatable about an eccentric secondary axis and arranged to orbit around the main axis to roll on the internal side surface of the cavity; and a vane located in the cavity, slidable in the piston and mounted in the body between one inlet and one outlet so as to oscillate. The orbiting piston and the vane divide in cyclic manner the cavity into a first and a second chamber with variable volume, which are mutually complementary and communicate with the inlet and the outlet. During a portion of its oscillation, the vane passes through the piston and is in contact with the side surface of the cavity, thereby separating the chambers in a fluid-tight manner.

13 Claims, 9 Drawing Sheets

(51) Int. Cl.

| | |
|---|---|
| ***F03C 4/00*** | (2006.01) |
| ***F04C 2/46*** | (2006.01) |
| ***F04C 11/00*** | (2006.01) |
| ***F04C 15/06*** | (2006.01) |
| *F04C 2/332* | (2006.01) |

(56) References Cited

U.S. PATENT DOCUMENTS

| | | | | | |
|---|---|---|---|---|---|
| 1,590,384 | A | | 6/1926 | Kucher | |
| RE22,160 | E | * | 8/1942 | Davis | 418/255 |
| 3,381,891 | A | | 5/1968 | Bellmer | |
| 3,563,678 | A | | 2/1971 | Sadler | |

FOREIGN PATENT DOCUMENTS

| | | | | | |
|---|---|---|---|---|---|
| DE | 10 2006 016 791 | A1 | | 10/2007 | |
| FR | 1.346.509 | A | | 12/1963 | |
| GB | 380344 | A | | 9/1932 | |
| JP | 57038687 | A | * | 3/1982 | F04C 2/344 |
| JP | 2005-337015 | A | | 12/2005 | |

* cited by examiner 84
85
54
56
16
18
12
14
110
185
184
154a
154b
156a
156b 84
85
54
56
16
18
12
210
185
291
184
154a
154b
156a
156b

POSITIVE DISPLACEMENT FLUID MACHINE HAVING A PIVOT SINGLE VANE PASSING THROUGH AN ORBITING PISTON

CROSS REFERENCE TO RELATED APPLICATIONS

This application is a National Stage of International Application No. PCT/IB2010/054061 filed Sep. 9, 2010, claiming priority based on Italian Patent Application No. TO2009A000705 filed Sep. 16, 2009, the contents of all of which are incorporated herein by reference in their entirety.

TECHNICAL FIELD

The present invention relates to an enclosed positive displacement mechanism, particularly for fluid machinery, and more specifically to an enclosed positive displacement mechanism.

The present invention further relates to a fluid machine comprising such a mechanism and to a rotating unit for such a mechanism.

PRIOR ART

In the field of positive displacement machines, it is known to use mechanisms of the type specified above in order to convey a fluid or to convert the kinetic energy of a fluid into another form of energy.

An example of such mechanisms is described in German Patent Application DE 10 2006 016 791, which discloses a vacuum pump structure. Such a pump has an enclosed positive displacement mechanism with a body defining a substantially cylindrical cavity and having an inlet port and an outlet port arranged to allow the inflow of a fluid into the cylindrical cavity and the outflow of said fluid from such a cylindrical cavity, respectively. The mechanism further includes a rotor mounted in the hollow body so as to be rotatable about a main axis or revolution axis, and an orbiting piston located in the cylindrical cavity and mounted onto the rotor so as to be rotatable about a secondary axis or rotation axis eccentrically located relative to the main axis so that the piston is arranged to orbit around said main axis and to roll on the internal surface of the cylindrical cavity. The mechanism further includes a vane, which is located in the cylindrical cavity, is slidable within the orbiting piston and is mounted in a peripheral portion of the hollow body between the inlet and outlet ports so as to be able to oscillate. The orbiting piston and the vane cooperate in such a way as to divide in a cyclic and fluid-tight manner said cylindrical cavity into a first chamber with variable volume and a second chamber with variable volume, which communicate with the inlet port and the outlet port, respectively.

A structure of an enclosed positive displacement mechanism similar to that described above is disclosed in French document FR 1 346 509.

Yet, enclosed positive displacement mechanisms of the kind described above have some drawbacks.

A drawback is that said mechanism is suitable for being used as a single positive displacement pump only, and cannot be adapted to fluid machines of different kinds.

Another drawback is that the structure of the moving parts of the mechanism is not balanced during rotation, whereby use of such a mechanism at high rotation speeds is not reliable.

A further drawback is that the structure of said mechanism cannot be easily adapted to the use with brushless electric motors.

SUMMARY OF THE INVENTION

It is an object of the present invention to make a versatile enclosed positive displacement mechanism having a structure that can be easily adapted to different applications and different kinds of fluid machines. More particularly, it is an object of the present invention to make an enclosed positive displacement mechanism that is suitable for being used as a single pump and can be adapted, through slight structural modifications, to operate as a pair of pumps arranged in parallel and/or as a pair of pumps arranged in series to form a double compression stage.

It is another object of the present invention to make an enclosed positive displacement mechanism in which the structure of the moving members is balanced during rotation so as to allow the mechanism to operate at high rotation speeds of such moving members.

It is a further object of the present invention to provide an enclosed positive displacement mechanism that is compatible with the use of brushless electric motors.

The above and other objects are achieved according to the present invention by providing an enclosed positive displacement mechanism as claimed in the appended claims.

As a skilled in the art can appreciate, the feature that the vane, during at least a portion of its oscillation, passes through the orbiting piston and is in contact with the internal side surface of the cylindrical cavity, thereby separating in fluid-tight manner the first and the second chamber, allows the mechanism to be adaptable in flexible manner to the use in different kinds of fluid machines. For instance, such a feature allows using the mechanism as a single pump, if the vane is mounted on the hollow body in such a manner that it passes through the orbiting piston and is in contact with the internal side surface of the cylindrical cavity only during a portion of its oscillation. At the same time, such a feature allows the mechanism to operate as a double pump (with parallel or serial arrangement) if the vane is mounted on the hollow body in such a manner that it passes through the orbiting piston and is in contact with the internal side surface of the cylindrical cavity during the whole of its oscillation, whereby the first and the second chamber are always separated by the vane during the mechanism operation. In this manner the costs for a large scale production of fluid machines of different kinds are reduced, in that said machines exploit a same base configuration of their rotating unit, which is subsequently mounted in the hollow body in a manner adapted to the intended use of the fluid machine.

It is intended that the claims are integral part of the technical teaching provided herein in respect of the invention.

BRIEF DESCRIPTION OF THE DRAWINGS

Further features and advantages of the present invention will become apparent from the following detailed description, given only by way of non limiting example with reference to the accompanying drawings, in which.

DETAILED DESCRIPTION

First Embodiment—Single Pump

Figure 1:
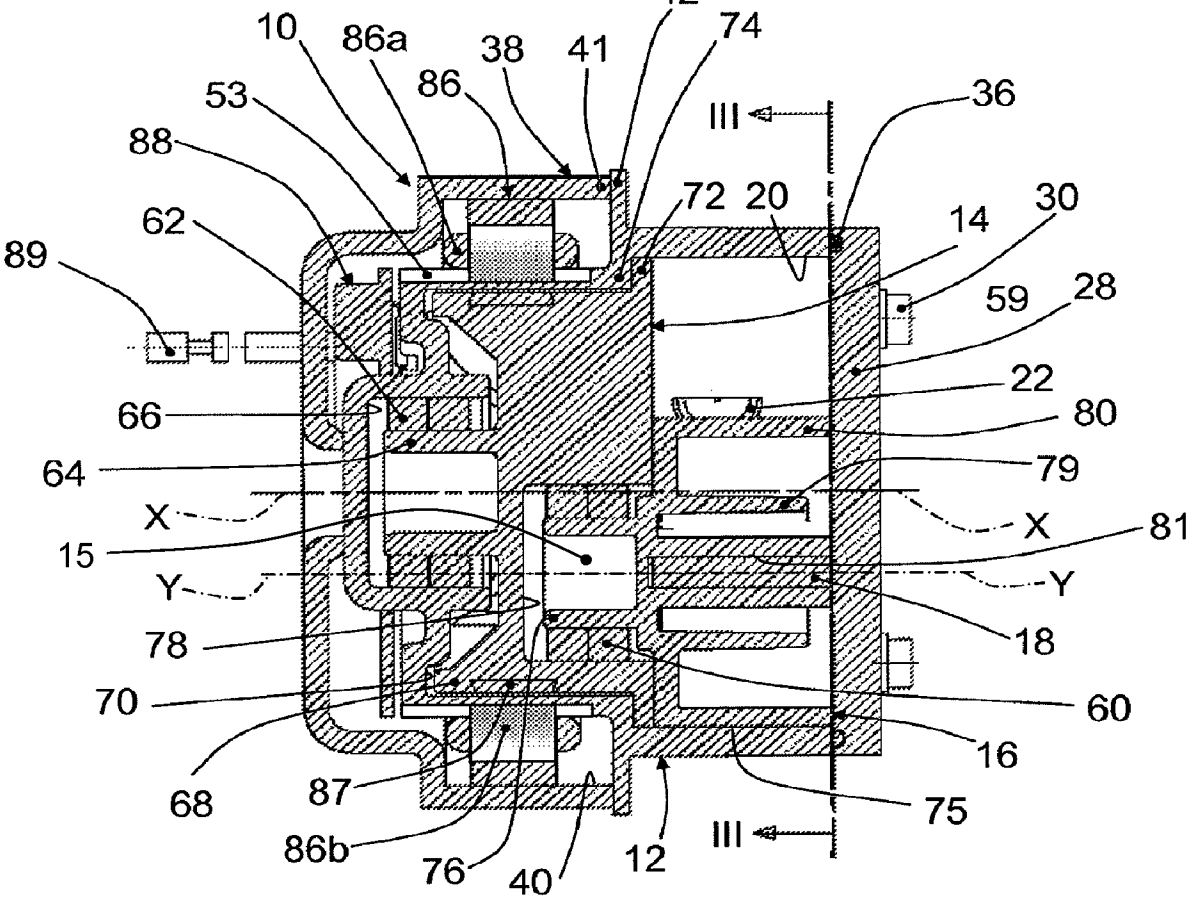
FIG. 1 is an axial sectional view of a first embodiment of an enclosed positive displacement mechanism according to the present invention.

Referring to FIGS. 1 to 3 and 4*a* to 4*d*, there is illustrated a first exemplary embodiment of an enclosed positive displacement mechanism 10 according to the present invention, used as a positive displacement pump.

Mechanism 10 includes a hollow body 12, a rotor 14, an orbiting piston 16 and a vane 18.

Body 12 is a housing defining a substantially cylindrical cavity 20 in which rotor 14, orbiting piston 16 and vane 18 are mounted. Said body 12 has an inlet port 22 and an outlet port 24. Inlet port 22 allows inflow of a fluid into cavity 20, and outlet port 24 allows outflow of the fluid from said cavity 20. Preferably, inlet and outlet ports 22 and 24 have substantially circular cross sections.

Body 12 is preferably made of a non-magnetic material, such as a thermoplastic or thermosetting material, or of an aluminium alloy. Polyphenylene sulphide (PPS) is preferred for use as a thermoplastic material, whereas phenolic plastics or resins (PF), charged with glass fibres, carbon fibres or aramidic fibres, are preferred as thermosetting materials. Advantageously, body 12 is made by moulding.

Figure 2:
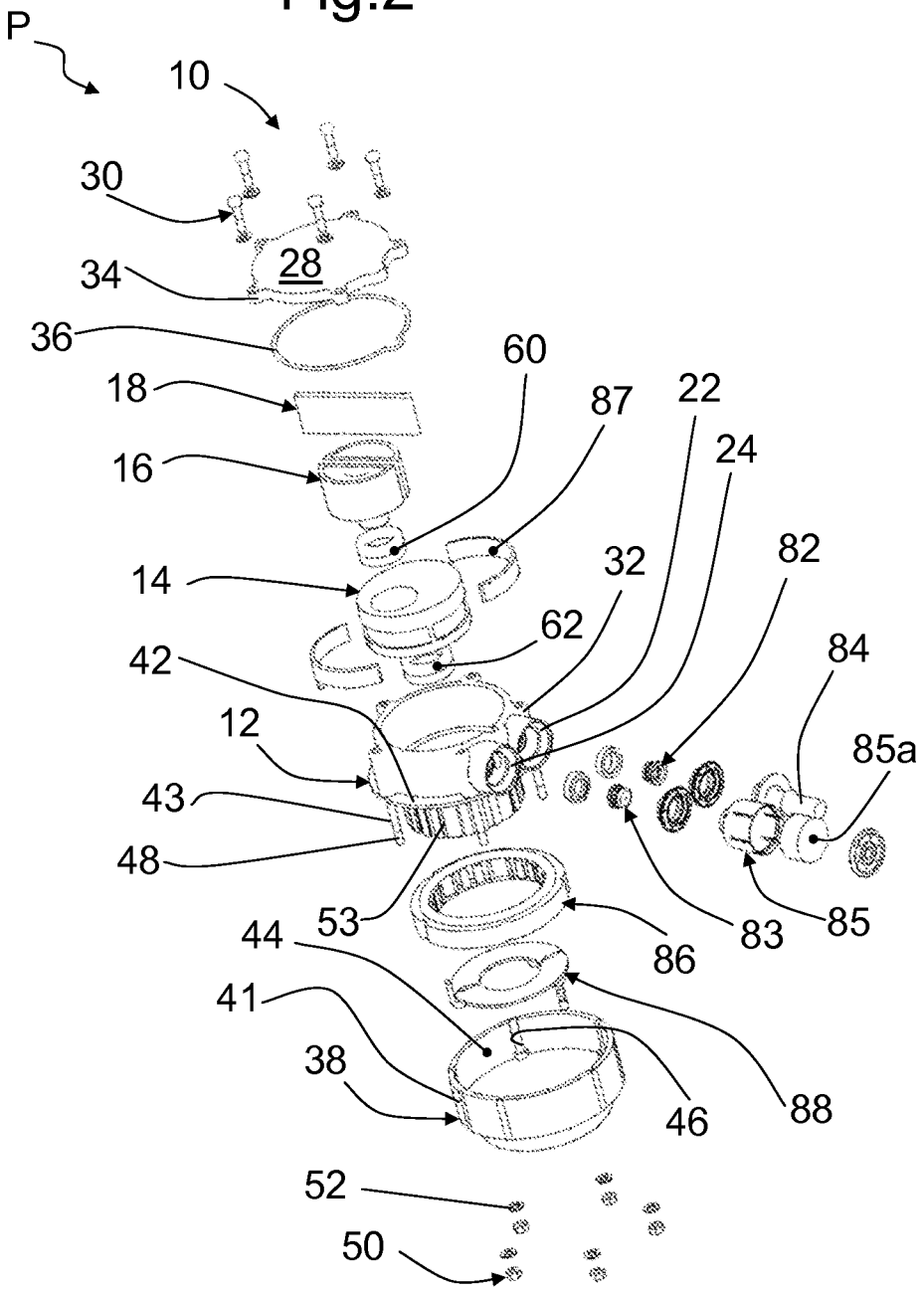
FIG. 2 is an exploded perspective view of the first embodiment of the enclosed positive displacement mechanism shown in FIG. 1.

Referring in particular to FIGS. 1 and 2, body 12 is substantially cup-shaped and is closed in fluid-tight manner by a cover 28 so as to define cavity 20. In this embodiment, body 12 is coupled with cover 28 by means of screws 30 that are inserted into corresponding throughholes formed in radial appendages 32 and 34, axially abutting against each other and projecting from body 12 and cover 28, respectively. A sealing gasket 36, intended to ensure fluid tightness of cavity 20 defined between body 12 and cover 28, is advantageously sandwiched between such elements.

Preferably moreover mechanism 10 further includes a substantially cup-shaped protecting casing 38 coupled with the bottom of body 12 so as to define an annular gap 40 (shown in FIG. 1) with that bottom. In this first embodiment, annular wall 41 of protecting casing 38 axially abuts against a radial flange 42 of body 12. Referring to FIG. 2, body 12 preferably has a set of finger-like formations 43 axially projecting from the side of radial flange 42 that, in assembled condition, is turned towards protecting casing 38. The internal side surface 44 of annular wall 41 has a set of radial recesses 46 intended to receive the corresponding set of finger-like formations 43. Preferably, the set of radial recesses 46 axially ends into a set of axial throughholes through which finger-like formations 43 can correspondingly project beyond the bottom of protecting casing 38 in order to be coupled with the latter. In this first embodiment, finger-like formations 43 have threaded end portions 48 that can be coupled, beyond the bottom of protecting casing 38, with nuts 50 and optionally with associated washers 52.

Preferably, body 12 further has a plurality of corresponding axially extending grooves 53 formed on the outer periphery of said body 12. Some of the advantageous aspects of said grooves will be described later on.

Referring to FIG. 1, rotor 14 is rotatable about a main axis or revolution axis X-X: Preferably, said main axis X-X coincides with the axis of cylindrical cavity 20. Orbiting piston 16 is mounted onto rotor 14 so as to orbit around main axis X-X and to be rotatable about an own secondary axis or rotation axis Y-Y eccentrically located relative to main axis X-X. Orbiting piston 16 is also capable of rolling on the internal side surface of cavity 20.

Rotor 14 is preferably made of a non-magnetic material, such as a thermoplastic or thermosetting material, or of an aluminium alloy. Advantageously, rotor 14 is made by moulding. In further variants, rotor 14 could even be made of magnetic material.

Figure 3:
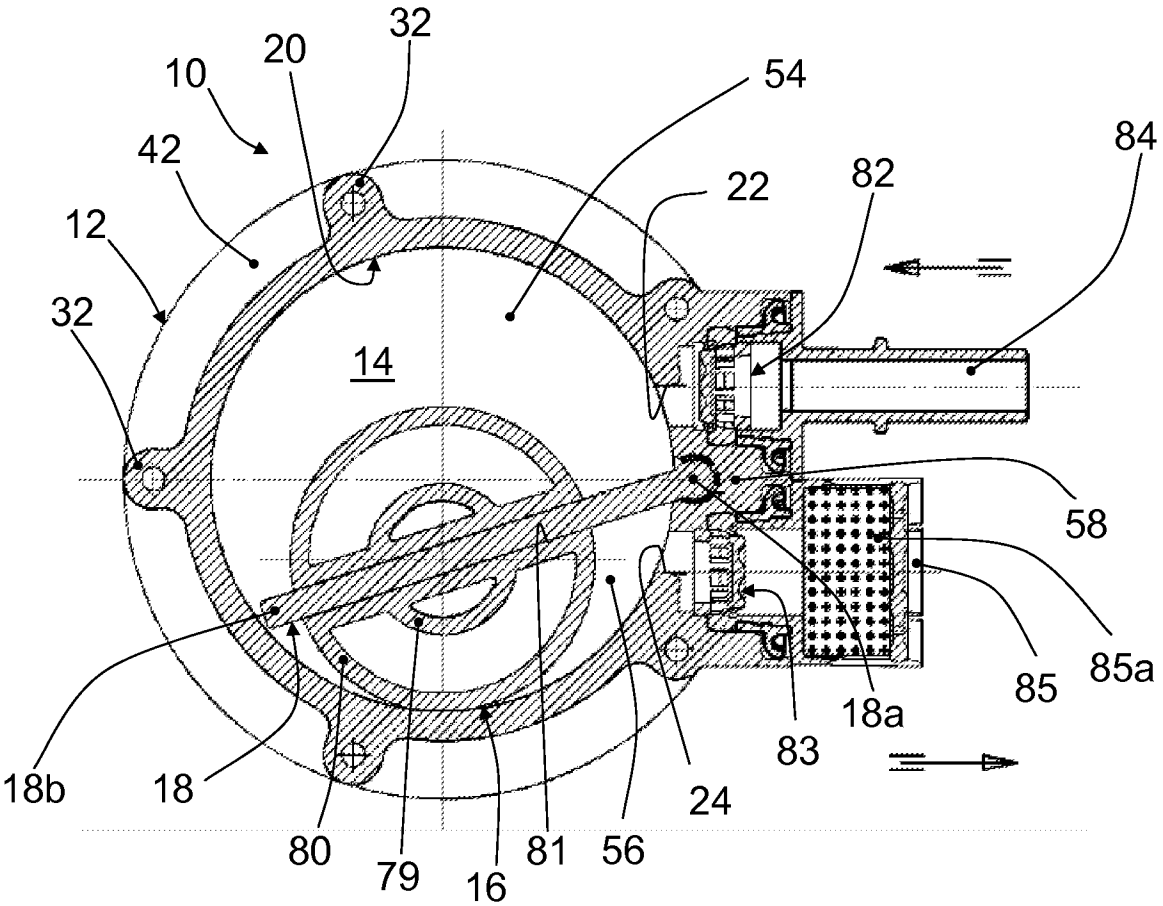
FIG. 3 is a radial sectional view of the first embodiment of the enclosed positive displacement mechanism, taken along line III-III of FIG. 1.

Moreover, as shown in FIG. 3, vane 18 is located in cavity 20 and is slidable in orbiting piston 16. Moreover, vane 18 is mounted in a peripheral portion 58 of body 12 included between inlet port 22 and outlet port 24 so as to be able to oscillate.

Advantageously, a proximal end 18*a* (FIG. 3) of vane 18 is mounted in peripheral portion 58 so as to allow vane oscillation.

As it will become apparent from the further description, orbiting piston 16 and vane 18 cooperate in such a way as to divide in a cyclic and fluid-tight manner cylindrical cavity 20 into a first chamber 54 with variable volume and a second chamber 56 with variable volume. The first chamber 54 and the second chamber 56 are complementary to each other and communicate with inlet port 22 and outlet port 24, respectively.

Vane 18 is mounted in body 12 so that, during a portion of its oscillation, it passes through orbiting piston 16 and is in contact with the internal side surface of cylindrical cavity 20, thereby separating in a fluid-tight manner the first chamber 54 and the second chamber 56. Advantageously, vane 18 is in contact with the internal side surface of cylindrical cavity 20 at one end, for instance distal end 18*b* (FIG. 3).

Preferably, rotor 14 has a balancing portion 15, which is located near the region where orbiting piston 16 is fastened and is intended to balance the rotation of the unit comprising rotor 14 and orbiting piston 16 about main axis X-X. Optionally, balancing portion is obtained as a plurality of lightened regions, for instance cavities, formed in rotor 14 so as to make the distribution of the mass of rotor 14 and orbiting piston 16 located about main axis X-X more uniform. Possibly, a further balancing portion, consisting for instance of a counterweight inserted into rotor 14 at a location diametrically opposite orbiting piston 16 with respect to main axis X-X, might also be provided.

Preferably, orbiting piston 16 is mounted on rotor 14 by means of a first bearing 60 (shown only schematically in FIGS. 1 and 2). Preferably moreover the first bearing 60 is a roller bearing.

Preferably, rotor 14 is mounted on body 12 by means of the second bearing 62. Preferably moreover the second bearing 62 is a ball bearing.

Optionally, said bearings 60, 62 are pre-lubricated in order to allow a "dry" operation thereof, without need of a subsequent further lubrication.

Preferably, the axes of ports 22 and 24 are substantially perpendicular to main axis X-X and secondary axis Y-Y. In the illustrated embodiment, ports 22 and 24 have parallel axes.

As shown in FIG. 1, rotor 14 optionally has a narrowed base neck 64 which is mounted in a bottom recess 66 of body 12. Advantageously, the second bearing 62 is interposed between the internal side surface of bottom recess 66 and the external side surface of neck 64. In this first embodiment, rotor 14 has a peripheral ring 68 radially extending from base neck 64 and projecting towards the bottom of body 12. Peripheral ring 68 is received in a corresponding annular groove 70 formed in the bottom of body 12. Further, rotor 14 axially extends as a cylindrical body from peripheral ring 68. Conveniently, rotor 14 ends with a radially widened top disc 72. Preferably, such a top disc 72 axially abuts in fluid tight manner against a shoulder 74 of body 12.

Preferably, orbiting piston 16 has an external cylindrical surface 75 that is tangentially in contact with and rolls on the internal cylindrical surface of cavity 20. Preferably moreover external cylindrical surface 75 slides in simultaneous axial contact with the internal top face of cavity 20 and the top of rotor 14. More specifically, external cylindrical surface 75 slides in axial contact with the internal side of cover 28 and the top face of top disc 72. Advantageously, top disc 72 of rotor 14 has a similar diameter to that of cavity 20 in which orbiting piston 16 rolls.

As further shown in FIG. 1, orbiting piston 16 optionally has a narrowed base neck 76, which is mounted in a top recess 78 of rotor 14. Advantageously, the first bearing 60 is interposed between the internal side surface of top recess 78 and the external side surface of neck 76. Preferably, a first glass-like body 79 projects from neck 76 and is directed away from top recess 78. Conveniently, as it can be appreciated by looking at FIGS. 1 and 3, a second glass-like body 80 projects radially outwards from the side walls of the first glass-like body 79. In this first embodiment, the first and second glass-like bodies 79, 80 are passed through by a pair of walls defining a diametrical slot 81 in which vane 18 is slidably mounted. As shown in FIG. 1, advantageously the second glass-like body 80 and the walls defining diametrical slot 81 are operatively in contact with the internal surface of cover 28. Thus, the second glass-like body 80 preferably defines the above-mentioned external cylindrical surface 75 of orbiting piston 16 that can remain self-centred without flexing since the first bearing 60 is advantageously made as a roller bearing.

Preferably, vane 18, pivotally mounted at peripheral portion 58, slides operatively in contact with the top surface of cavity 20 and with the top of rotor 14, thereby providing a fluid seal. Advantageously, vane 18 slides in contact with the internal side of cover 28 and the top surface of top disc 72.

Preferably, mechanism 10 includes an inlet non-return valve 82 and an outlet non-return valve 83 associated with inlet port 22 and outlet port 24, respectively. Optionally, inlet non-return valve 82 and outlet non-return valve 83 are interposed in fluid tight manner between inlet port 24 and an inlet fitting 84 and between outlet port 24 and an outlet fitting 85, respectively. Preferably, a silencing filter 85*a*, of a kind known per se, is located in outlet fitting 85.

Preferably, rotor 14 is made to rotate by an electric motor. More preferably, rotor 14 is made to rotate about main axis X-X by a brushless electric motor. In the illustrated embodiment, the electric motor of mechanism 10 includes an electromagnetic stator 86 with a plurality of conducting windings 86*a* and a plurality of polar expansions 86*b*. Further, the electric motor of mechanism 10 includes a rotor portion with a plurality of permanent magnets 87 located on the periphery of rotor 14. Electromagnetic stator 86 and permanent magnets 87 are arranged to electromagnetically interact as an electrical machine.

Preferably, polar expansions 86*b* are made as a plurality of teeth radially projecting towards the inside of stator 86 and coupled by radial interference with grooves 53 of body 12. Advantageously, said coupling allows firmly fitting electromagnetic stator 86 onto body 12 and at the same time reducing the air gap between polar expansions 86*b* and permanent magnets 87.

In this first embodiment, mechanism 10 includes an electronic control unit (ECU) 88 connected to conducting windings 86*a* and arranged to control, in a manner known per se, the flow of electric current through conducting windings 86*a* acting as electromagnets. Control unit 88 is mounted in body 12 outside cavity 20. For instance, electronic control unit 88 is a printed circuit board of a type known per se. Moreover, control unit 88 receives the power supply through a conducting cable 89. Preferably, control unit 88 is located in annular gap 40 opposite rotor 14. Conveniently, such a control unit 88 is arranged to detect the magnetic pulses generated by the rotation of permanent magnets 87 carried by rotor 14 so as to manage/adjust the rotation speed of the rotor. Advantageously, electromagnetic stator 86 is located between the outside of body 12 and the inside of protecting casing 38. Preferably, electromagnetic stator 86 is located in annular gap 40 radially outwards of magnetic polar expansions 87, which are located in the side periphery of rotor 14. Advantageously, control unit 88 can control, in an electronically controlled manner, the rotation speed of rotor 14.

More particularly, by applying in known manner suitable pressure sensors to the pump and by connecting them to control unit 88, it is possible to electronically change the pump speed while keeping the pressure level constant.

As it is apparent from FIGS. 4*a* to 4*d*, mechanism 10 according to the first embodiment operates as a positive displacement pump.

Figure 4B:
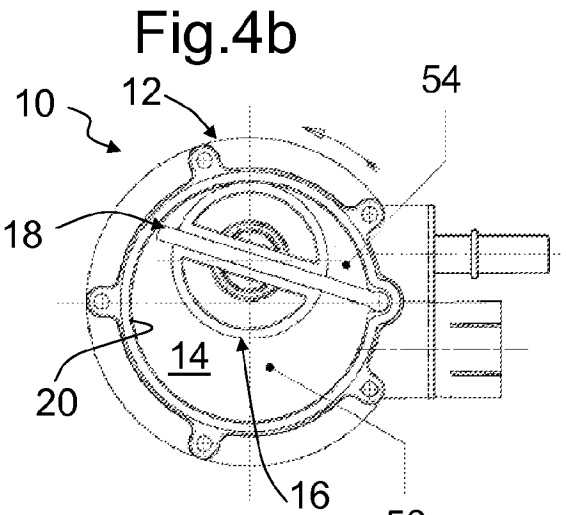
FIGS. 4*a* to 4*d* show an operating sequence of the first embodiment of the enclosed positive displacement mechanism.
Figure 4A:
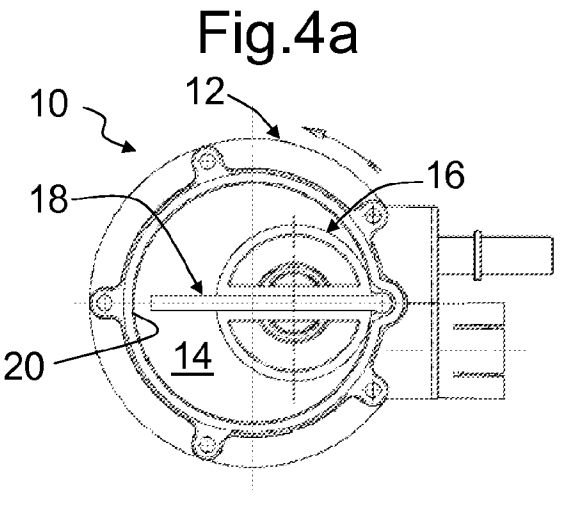

FIG. 4*a* shows mechanism 10 in a starting configuration of the oscillation of vane 18. In such a condition, orbiting piston 16 is at a minimum distance from peripheral portion 58 where vane 18 is pivoted. Moreover, the free end of vane 18 is not in contact with the internal surface of cavity 20 and hence, in such a step, such a cavity 20 is not divided into two different chambers. Moreover, both non-return valves 82, 83 (not shown in these Figures) are closed.

FIG. 4*b* shows mechanism 10 in a subsequent configuration in which rotor 14 is rotated by 90° in counterclockwise direction relative to the starting configuration. In such a condition, orbiting piston 16 is at an intermediate position between peripheral portion 58 and the free end of vane 18. Moreover, orbiting piston 16 is in contact with the internal surface of cavity 20. Vane 18 is displaced by orbiting piston 16 into such an angular arrangement that its free end is in contact with the internal surface of cavity 20. In this way, vane 18 and the external surface of orbiting piston 16 divide cavity 20 into the first chamber 54, which has a smaller volume, and the second chamber 56, which has a greater volume. In such a configuration, the first chamber 54 starts the intake phase, whereas the second chamber 56 is in a compression phase.

Figure 4D:
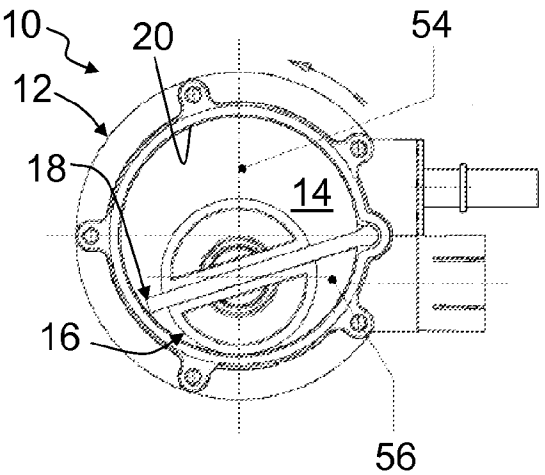
Figure 4C:
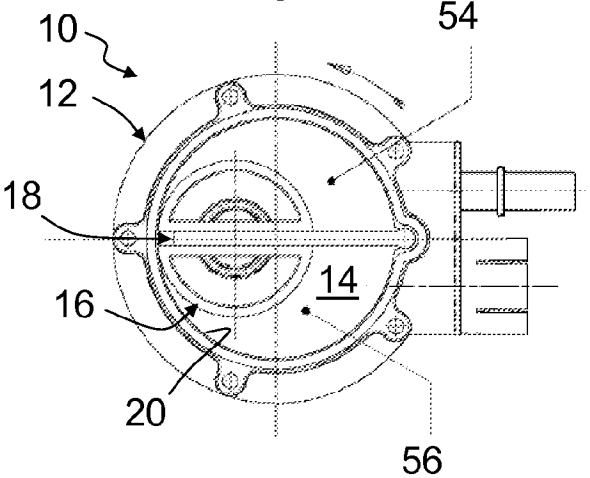

FIG. 4*c* shows mechanism 10 in a subsequent configuration in which rotor 14 is rotated by 180° in counterclockwise direction relative to the starting configuration. In such a condition, orbiting piston 16 is at a maximum distance from the peripheral portion 58 where vane 18 is pivoted. Vane 18 is again in the same angular position as shown in FIG. 4*a*, and hence it is spaced from the internal surface of cavity 20. Yet, the external surface of orbiting piston 16 is in contact with the internal surface of cavity 20, thereby keeping the first and second chambers 54, 56 separate, said chambers having now substantially the same volume. In such a configuration, the first chamber 54 has increased its volume and is arranged to continue its expansion, whereas the second chamber 56 has decreased its volume and is arranged to continue the compression phase.

FIG. 4*d* shows mechanism 10 in a subsequent configuration in which rotor 14 is rotated by 270° in counterclockwise direction relative to the starting configuration. In such a condition, orbiting piston 16 is at an intermediate position between peripheral position 58 and the free end of vane 18. Furthermore, vane 18 is displaced by orbiting piston 16 into such an angular arrangement that its free end is in contact with the internal surface of cavity 20. In this way, vane 18 and the external surface of orbiting piston 16 keep cavity 20 divided into the first and second chambers 54, 56. Thanks to the contact of the external surface of orbiting piston 16 and of the free end of vane 18, respectively, with the internal surface of cavity 20, the volume of the first chamber 54 reaches its maximum expansion, whereas the volume of the second chamber 56 is reduced to a minimum. The compression phase of the second chamber 56 is ending, and mechanism 10 is about to resume the starting configuration shown in FIG. 4*a*.

Second Embodiment—Double Pump (Parallel Arrangement)

Referring to FIGS. 5 and 6*a* to 6*d*, a second embodiment of the enclosed positive displacement mechanism according to the present invention is denoted 110. Mechanism 110 has several of the features previously disclosed in the detailed description of the first embodiment, as well as a number of peculiar aspects that will be described below.

Parts and components similar or having similar functions to those of the embodiment previously described are denoted by the same alphanumerical symbols. For sake of conciseness, such parts and components are not described again.

Figure 5:
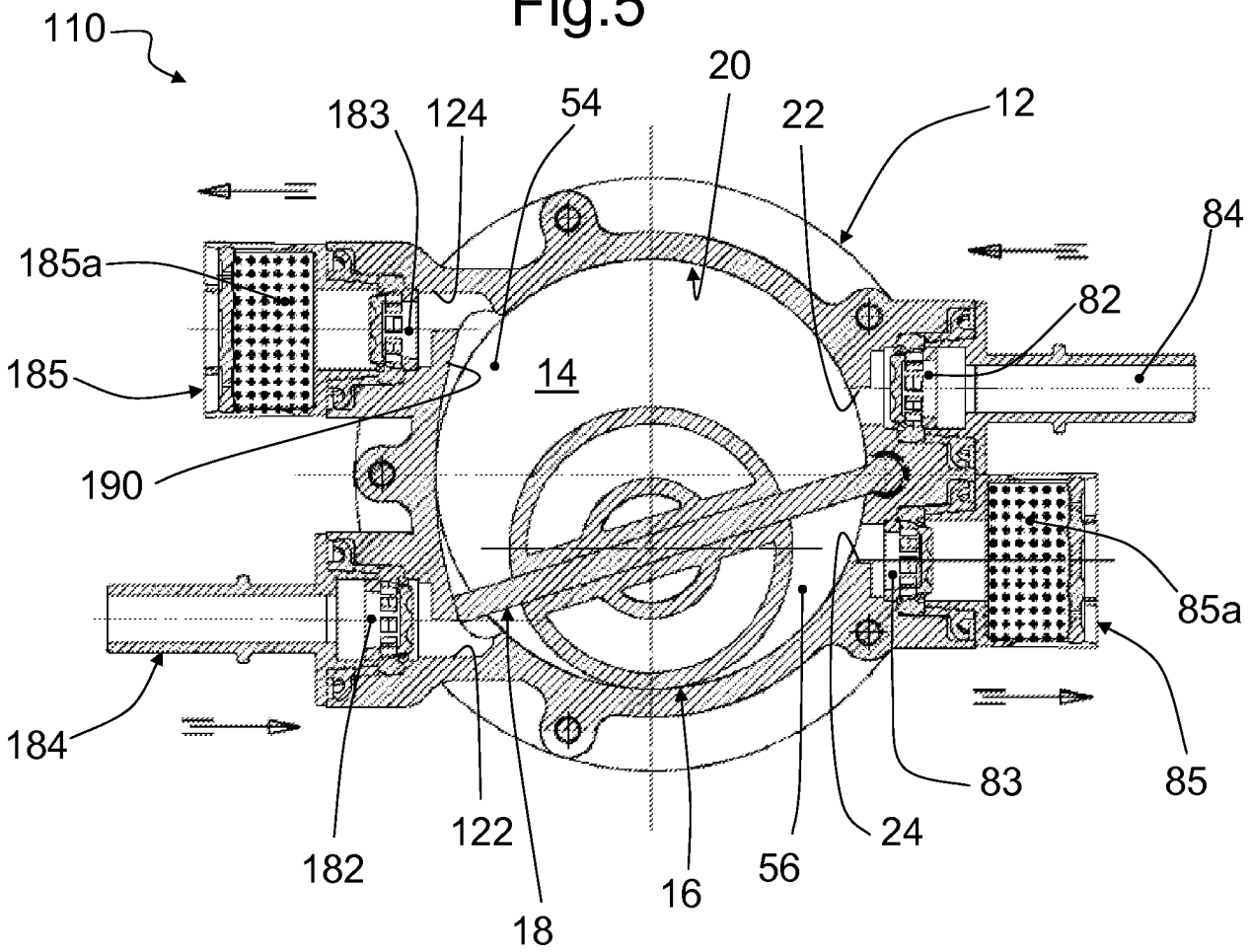
FIG. 5 is a radial sectional view similar to FIG. 3, but related to a second embodiment of the enclosed positive displacement mechanism according to the present invention.

Referring to FIG. 5, mechanism 110 has a further inlet port 122 arranged to allow fluid inflow into cavity 20 and a further outlet port 124 arranged to allow fluid outflow from cavity 20. Vane 18 is mounted in body 12 so that it passes through orbiting piston 16 and is guided in contact with the internal side surface of cylindrical cavity 20 during the whole of its oscillation, thereby separating the further inlet and outlet ports 122, 124 in fluid-tight manner. In this manner, the first chamber 54 communicates with input port 22 and the further outlet port 124, and the second chamber 56 communicates with the further input port 122 and outlet port 24.

With respect to the first embodiment, while keeping the size unchanged, it is possible to use mechanism 110 as a pair of positive displacement pumps arranged in parallel, in which fluid flows are directed in opposite directions.

Preferably, a further inlet non-return valve 182 and a further outlet non-return valve 183 are provided and are associated with the further inlet port 122 and the further outlet port 124, respectively.

Preferably, the further inlet and outlet non-return valves 182, 183 are interposed between the further ports 122 and 124 and a further inlet fitting 184 and a further outlet fitting 185, respectively, the latter being equipped with a corresponding silencing filter to 185*a*.

Preferably, input port 22 and the further outlet port 124 are aligned on the same axis. Preferably, the further input port 122 and outlet port 24 are aligned on the same axis.

In this second embodiment, an arc-shaped sector 190, on which the free end of vane 18 is arranged to tangentially slide in guided manner, is hollowed out of the internal side surface of cavity 20.

In alternative to arc-shaped sector 190, embodiments are also envisaged in which vane 18 is equipped with a spring-biased point arranged to remain in contact with internal surface 20, which in such case may even be cylindrical like in the first embodiment.

Referring in particular to FIGS. 6*a* to 6*d*, orbiting piston 16 preferably cooperates with vane 18 so as to further divide the first chamber 54 and the second chamber 56 during operation of mechanism 110. The operational configurations shown in FIGS. 6*a* to 6*d* are similar to those shown in FIGS. 4*a* to 4*d* related to the first embodiment. In particular, the relative angular positions of rotor 14, orbiting piston 16 and vane 18 are substantially the same as those shown in said FIGS. 4*a* to 4*d*. Yet, one of the main differences is that in this second embodiment vane 18 passes through orbiting piston 16 during the whole of its oscillation and is guided in contact with arc-shaped sector 190, which has such a depth that it ends in correspondence of the plane of top disc 72 of rotor 14, thereby separating in a fluid-tight manner the first chamber 54 and the second chamber 56.

Figures 6A, 6B, 6C, 6D:
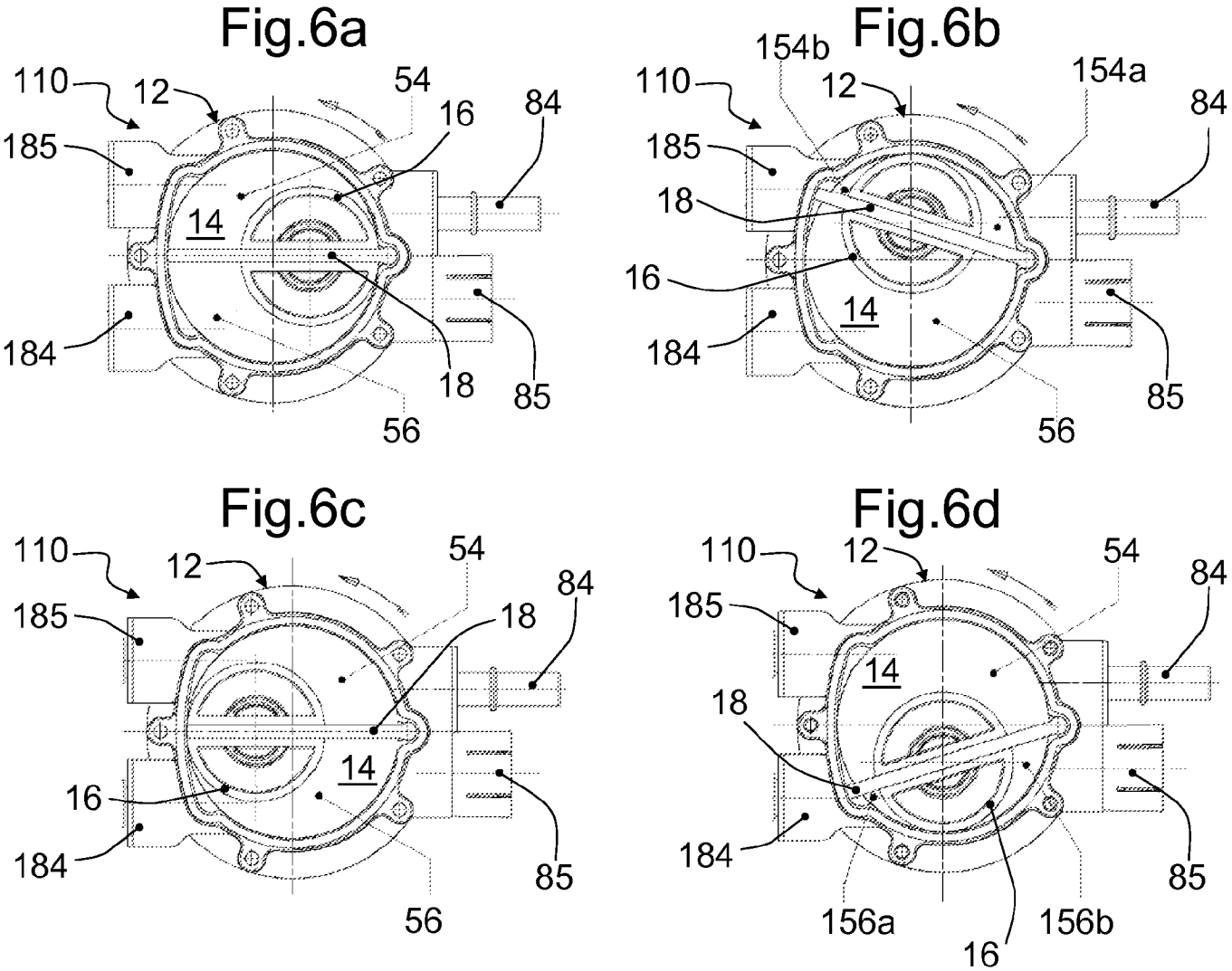
FIGS. 6*a* to 6*d* show an operating sequence of the second embodiment of the enclosed positive displacement mechanism.

FIG. 6*a* shows mechanism 110 in a starting configuration of the oscillation of vane 18. In such a condition, the cooperation between orbiting piston 16 and vane 18 divides cavity 20 into the first and second chambers 54, 56, similarly to what has been shown in FIG. 4*b* for the first embodiment. In this step, the first chamber 54 is in a compression phase, whereas the second chamber 56 in an expansion phase.

FIG. 6*b* shows mechanism 110 in a subsequent configuration in which rotor 14 is rotated by 90° in counterclockwise direction relative to the starting configuration. In such a condition, the cooperation between orbiting piston 16 and vane 18 allows dividing the first chamber 54 into a first inlet half-chamber 154*a* communicating with inlet port 22 and a first outlet half-chamber 154*b* communicating with the further outlet port 124. More specifically, the first inlet half-chamber 154*a* is defined between the external surface of orbiting piston 16, the proximal portion of vane 18 and the internal surface of cavity 20 located near inlet port 22. More in detail, the first outlet half-chamber 154*b* is defined between the external surface of orbiting piston 16, the distal portion of vane 18 and the internal surface of cavity 20 located near the further outlet port 124. The first inlet half-chamber 154*a* is in an intake phase, whereas the first outlet half-chamber 154*b* is in a compression phase. At the same time, expansion of the volume of the second chamber 56 up to its maximum value occurs.

FIG. 6*c* shows mechanism 110 in another subsequent configuration in which rotor 14 is rotated by 180° in counterclockwise direction relative to the starting configuration. In such a condition, the cooperation between orbiting piston 16 and vane 18 makes the first chamber 54 again unitary and at the same time reduces the volume of the second chamber 56, which is in a compression phase.

FIG. 6*d* shows mechanism 110 in a further subsequent configuration in which rotor 14 is rotated by 270° in counterclockwise direction relative to the starting configuration.

In such a condition, the cooperation between orbiting piston 16 and vane 18 allows dividing the second chamber 56 into a second inlet half-chamber 156*a* communicating with the further inlet port 122 and a second outlet half-chamber 156*b* communicating with outlet port 24. More specifically, the second inlet half-chamber 156*a* is defined between the external surface of orbiting piston 16, the distal portion of vane 18 and the internal surface of cavity 20 located near the further inlet port 122. More in detail, the second outlet half-chamber 156*b* is defined between the external surface of orbiting piston 16, the proximal portion of vane 18 and the internal surface of cavity 20 located near outlet port 24. The second inlet half-chamber 156*a* is in an intake phase, whereas the second outlet half-chamber 156*b* is in a compression phase. At the same time, expansion of the volume of the first chamber 54 up to its maximum value occurs.

Third Embodiment—Double Pump (Serial Arrangement)

Figure 7:
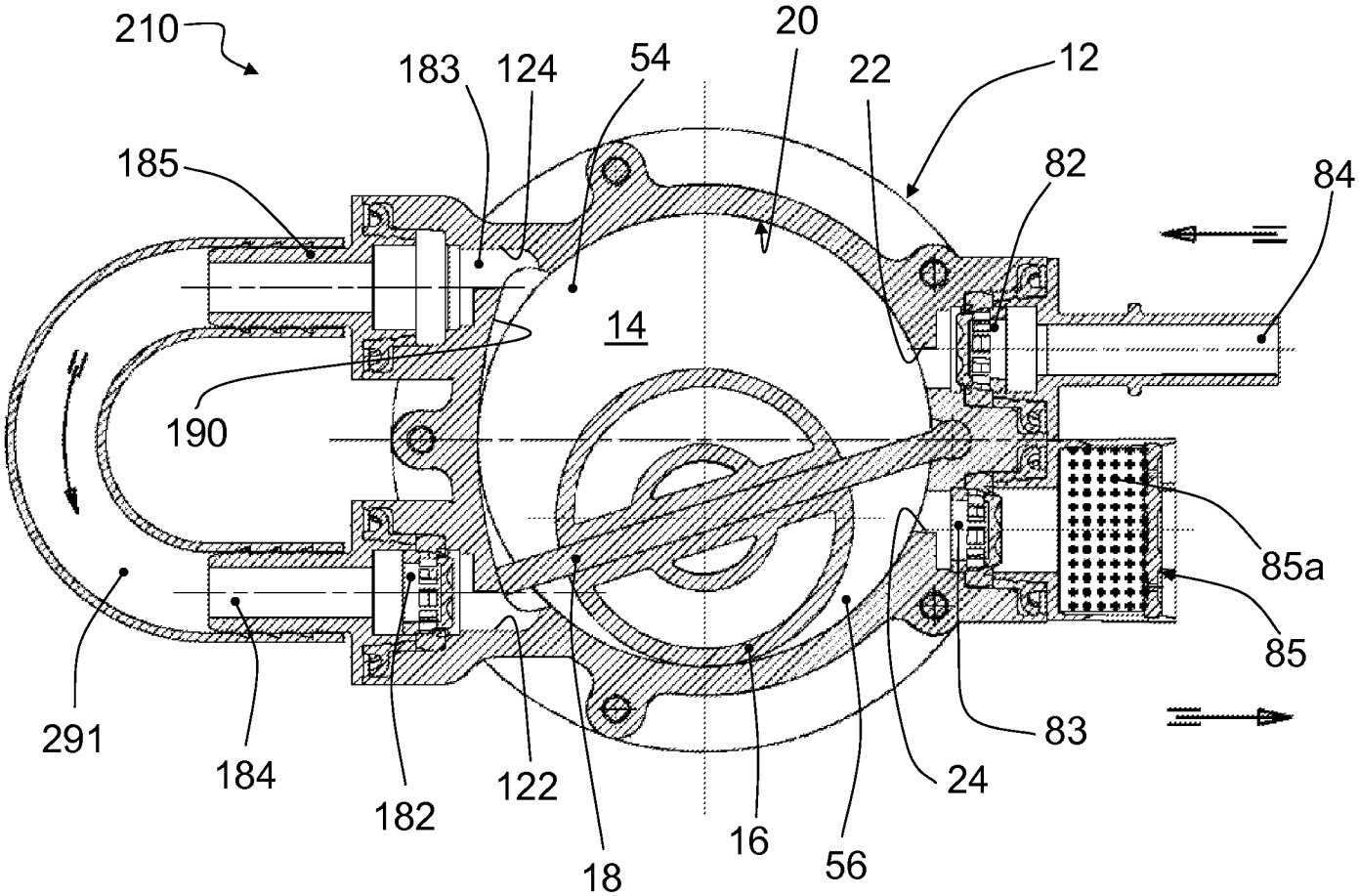
FIG. 7 is a radial sectional view similar to FIGS. 3 and 5, but related to a third embodiment of the enclosed positive displacement mechanism.

Referring to FIG. 7, a third embodiment of the enclosed positive displacement mechanism according to the present invention is denoted 210. Mechanism 210 has several of the features previously described in the detailed description of the second embodiment, as well as a number of peculiar aspects, some of which will be disclosed now.

Parts and components similar or having similar functions to those of the second embodiment previously described are denoted by the same alphanumerical symbols. For sake of conciseness, such parts and components are not described again.

Also in this third embodiment it is envisaged, in alternative to the provision of arc-shaped sector 190, that vane 18 has a spring-biased point arranged to remain in contact with internal surface 20, which in such case may even be cylindrical like in the first embodiment.

Unlike the second embodiment, mechanism 210 has a further duct 291 that connects the further outlet port 124 to the further inlet port 122. Thanks to such a feature, it is possible to use mechanism 210 as a pair of pumps with a "double stage" serial arrangement, since the first and second chambers 54, 56 form first and second compression stages arranged in series.

Preferably, duct 291 is U-shaped. Advantageously, duct 291 is connected between the further inlet fitting 184 and the further outlet fitting 185.

With respect to the second embodiment, the further outlet non-return valve 183 is missing, whereas the further inlet non-return valve 182 is provided. In a further alternative embodiment, the further inlet and outlet non-return valves 182 and 183 might be provided both.

The operation of mechanism 210 is illustrated in FIGS. 8*a* to 8*d* and has several similarities with that disclosed with reference to FIGS. 6*a* to 6*d* related to the second embodiment. Actually, the different relative angular positions of rotor 14, orbiting piston 16 and vane 18, as well as the different operating divisions of the first chamber 54 and the second chamber 56 are substantially the same as those shown in said FIGS. 6*a* to 6*d*.

Figures 8A, 8B, 8C, 8D:
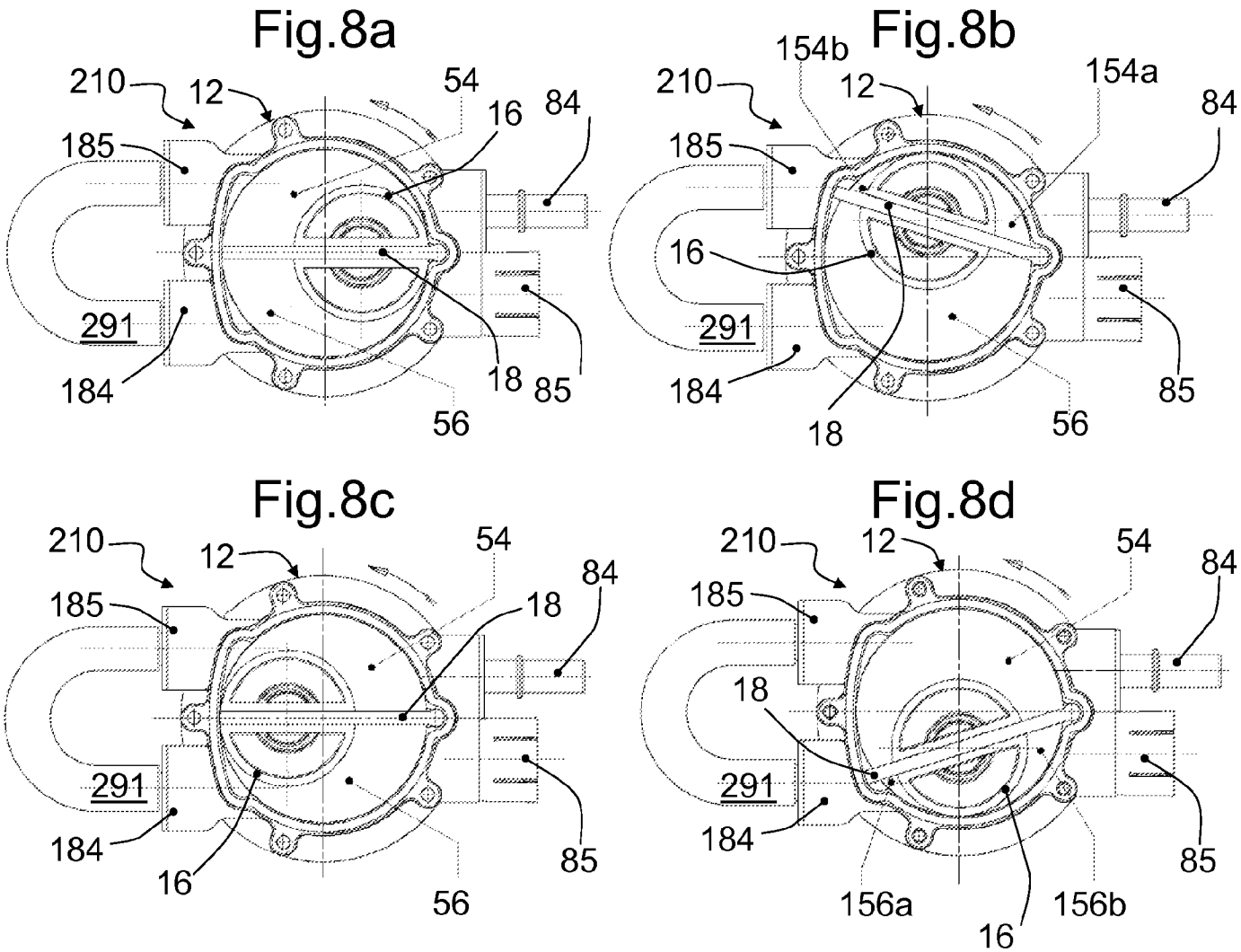
FIGS. 8*a* to 8*d* show an operating sequence of the third embodiment of the enclosed positive displacement mechanism.

In such a third embodiment, mechanism 210 does not operate as a double pump with parallel arrangement, but as a double pump with serial arrangement with two different compression stages. Actually, the fluid inflowing through inlet port 22 is subjected to a first compression stage in the first chamber 54 and is discharged through the further outlet port 124 (operating sequence: FIG. 8*d*-FIG. 8*a*-FIG. 8*b*). Moreover, such a fluid inflows again through the further inlet port 122, is subjected to a second compression stage in the second chamber 56 and is discharged through outlet port 24 (operating sequence: FIG. 8*b*-FIG. 8*c*-FIG. 8*d*).

Fourth Embodiment—Single or Double or Double Stage Pump with Double Motor

Figure 9:
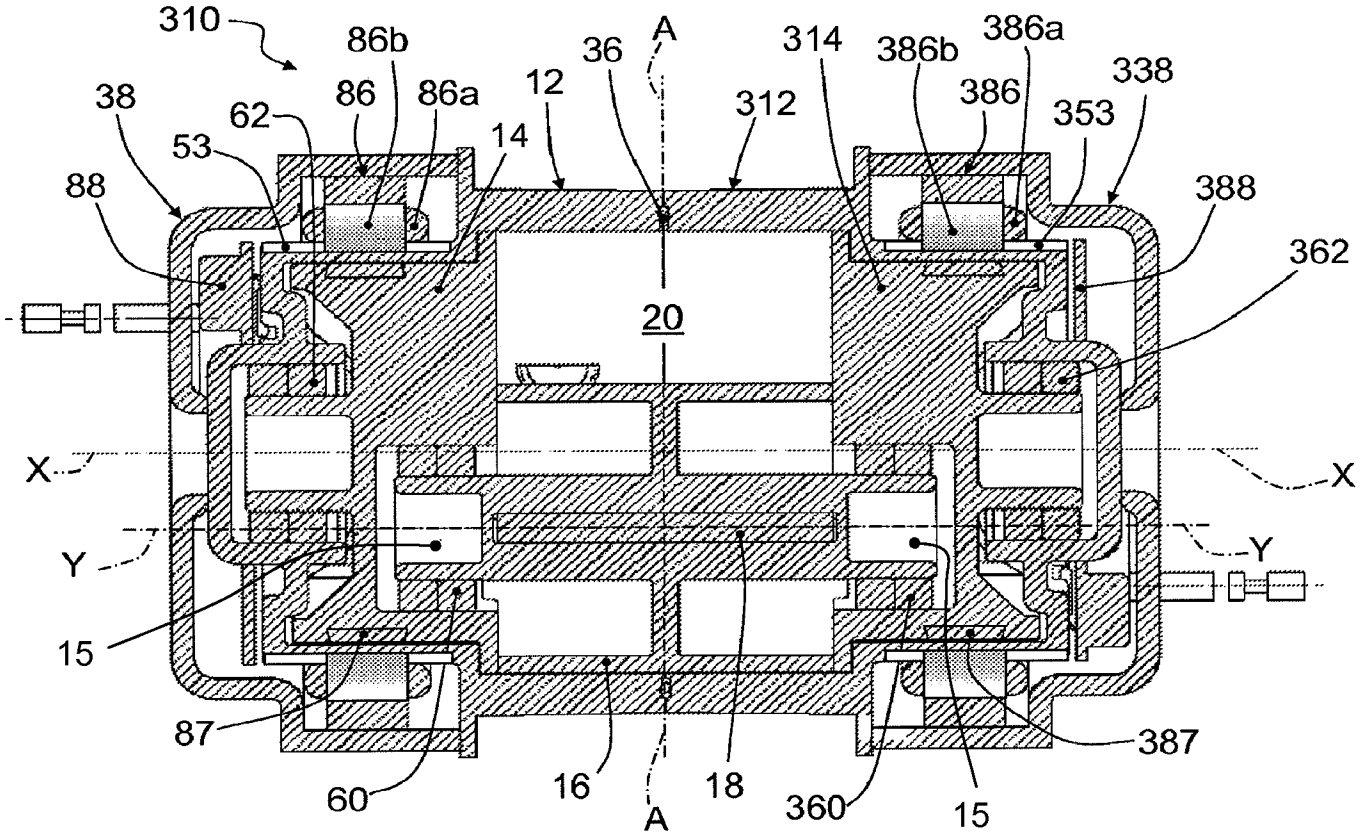
FIG. 9 is a radial sectional view similar to FIGS. 3, 5 and 7, but related to a fourth embodiment of the enclosed positive displacement mechanism.

Referring to FIG. 9, a fourth embodiment of the enclosed positive displacement mechanism according to the present invention is denoted 310. Mechanism 310 has several of the features previously disclosed in the detailed description of the various embodiments, as well as a number of peculiar aspects, some of which will be described now.

Parts and components similar or having similar functions to those of the first embodiment previously described are denoted by the same alphanumerical symbols. For sake of conciseness, such parts and components are not described again.

Mechanism 310 has a further rotor 314 located on the opposite side of rotor 14 with respect to vane 18. The further rotor 314 is rotatable about main axis X-X. Orbiting piston 16 is mounted between rotors 14, 314 so as to orbit around main axis X-X and to be rotatable about secondary axis Y-Y. In other words, a single orbiting piston 16 and a single vane 18 are substantially "sandwiched" between the pair of rotors 14, 314.

Of course, in other embodiments, separate orbiting pistons each equipped with a respective vane and separate cavities 20 can be provided.

Thanks to such an arrangement, orbiting piston 16 can be made to orbit around main axis X-X by a pair of separate and electronically synchronised motors, each connectable with one of rotors 14, 314.

Preferably, the structure of mechanism 310 is substantially doubled with respect to that of the embodiments already described, and it extends along main axis X-X. More specifically, such a doubling takes place in symmetrical manner with respect to a plane A-A perpendicular to main axis X-X and passing in correspondence of the internal side of cover 28 (which therefore is missing in this fourth embodiment). Mechanism 310 thus includes a first hollow body 12 and a second hollow body 312, which are assembled at their open ends like two half-shells forming a single casing and defining, in the example illustrated, a single cavity 20. Preferably, a first protecting casing 38 is mounted on the first body 12, and a second protecting casing 338 is mounted on the second body 312.

Taking into account such symmetry, the components arranged in mirror-like positions with respect to the first embodiment will not be described. Yet, for sake of completeness, some of the main components arranged in mirror-like positions have been denoted in FIG. 9 by the same reference numerals as used in FIG. 1, preceded by digit 3.

The mechanism of the fourth embodiment allows making, for instance, single, double and double-stage pumps, depending on the shape of the cavity or the vane and on the number and arrangement of the ducts, as shown, mutatis mutandis, in the different embodiments.

Advantageously, the mechanism of the fourth embodiment is particularly balanced, since rotors 14, 314, being symmetrically coupled, do not have cantilevered surfaces that, at high speeds, could exhibit flexion problems.

Further Variant Embodiments

Mechanisms with one inlet port 22 and one outlet port 24 as well as mechanisms with two inlet ports 22 and 122, respectively, and two outlet ports 24 and 124, respectively, have been shown in the embodiments described above.

In embodiments in which the mechanism includes, for instance, an elongated cavity or in which, for instance, it is useful to take different pressure levels from the cavity, the number of ports can exceed the disclosed one, without thereby departing from the scope of what is described and claimed.

In the embodiments described above, the mechanisms have been used as positive displacement pumps. Yet, such mechanisms can also be used as turbines actuated by a moving fluid, which is made to flow through the cavity by being admitted through the inlet port(s) and being discharged through the outlet port(s). Hence, the disclosed mechanisms can be installed for use as work absorbing fluid machines (in which the machine transfers energy to the fluid) or for use as work producing fluid machines (in which the fluid transfers energy to the machine). For instance, the electromagnetic interaction between the conducting windings and the permanent magnets may take place in order to convert the kinetic energy generated by the rotation of the rotor caused by the fluid flowing in the cylindrical cavity into electric energy. Moreover, also a reversible operation of the mechanism is conceivable, in which the electromagnetic stator and the permanent magnets interact as a reversible electrical machine that can act both as a motor and as a generator.

Further, the mechanisms disclosed herein have been associated with a brushless electric motor. This feature safeguards in advantageous manner the fluid-tight sealing of the hollow body having the moving components located inside it. Actually, in this manner, the hollow body does not require further openings for a mechanical connection to further external moving components arranged to impart the motion to the rotor.

In summary, the mechanisms as disclosed in the different preferred embodiments are made as devices having no external mechanisms and no external controls, so that their operation, for instance in case of use as pumps, only needs an external electric power supply.

In any case, in other variant embodiments, also different kinds of driving devices can be employed for using such mechanisms as positive displacement pumps. For instance, the rotor can be connected with an external driving shaft that, when assembled, passes through the hollow body of the mechanism.

As it is apparent for a skilled in the art, the term "enclosed positive displacement mechanism" in the present description and in the claims is to be intended in its most general sense, that is as a positive displacement machine in which a given volume of fluid is periodically and alternately put in communication with two separate environments at different pressures by means of the relative motion of the members forming the mechanism.

Clearly, similar and functionally equivalent features of the different embodiments and variants described and shown herein can be mutually exchanged, where they are compatible. For instance, the peculiar aspects of the fourth embodiment can be implemented also in the second and third embodiments. Otherwise stated, a structure including two rotors rotatable about a same main axis and located on axially opposite sides of the single orbiting piston and the single vane can also be used in the mechanisms shown in the second and third embodiments.

Of course, the manners of putting the invention into practice and the construction details can be widely changed with respect to what has been described and shown only by way of non limiting example, without thereby departing from the scope of the present invention as defined in the appended claims.

The invention claimed is:

1. Enclosed positive displacement mechanism, comprising:

a body defining a cylindrical cavity with an internal side surface and having at least a first and a second inlet port and at least a first and a second outlet port intended to allow a fluid to inflow into said cavity and to allow said fluid to outflow from said cavity, respectively;

a rotor mounted in said body so as to be rotatable about a main or revolution axis; an orbiting piston, which is located in said cavity, is mounted on said rotor so as to be rotatable about a secondary or rotation axis eccentric with respect to said main axis and is arranged to roll on the internal side surface of said cavity; and a single vane slidable in said orbiting piston, said vane is mounted in a peripheral portion of said body located between one of said inlet ports and one of said outlet ports, contiguous to said one of the inlet ports, so as to oscillate in use, and is mounted in said body so as to pass through said orbiting piston and is guided with a free end of said vane in contact with the internal side surface of said cavity, wherein an arc-shaped sector, which delimits the oscillation of said vane and on which the free end of said vane is arranged to tangentially slide during an entire oscillation, is hollowed out of the internal side surface of said cavity.

2. The enclosed positive displacement mechanism according to claim 1, wherein said vane and said orbiting piston cooperate so as to divide in a cyclical manner said cylindrical cavity into:

at least a first inlet chamber with variable volume, arranged to intake said fluid from said at least a first inlet port, and at least a first outlet chamber with variable volume arranged to supply said at least a second outlet port with said fluid; and at least a second inlet chamber with variable volume, arranged to intake said fluid from said at least a second inlet port, and at least a second outlet chamber with variable volume arranged to supply said at least a first outlet port with said fluid.

3. The enclosed positive displacement mechanism according to claim 1, further comprising a duct connecting said at least a second outlet port with said at least a second inlet port.

4. The enclosed positive displacement mechanism according to claim 3, comprising an inlet non-return valve associated with said at least a second inlet port.

5. The enclosed positive displacement mechanism according to claim 1, comprising in addition a further rotor located axially in opposition to said rotor with respect to said vane and rotatable about said main axis; said orbiting piston being mounted between said rotors so as to orbit, in use, around said main axis and to be rotatable about the secondary axis.

6. The enclosed positive displacement mechanism according to claim 5, wherein said rotor or each said rotor has a balancing portion intended to balance the rotation about said main axis of the unit comprising said rotor or said rotors and said orbiting piston.

7. The enclosed positive displacement mechanism according to claim 5, wherein said rotor or each said rotor includes a plurality of permanent magnets located on the periphery of the rotor and arranged to magnetically interact with an electromagnetic stator.

8. The enclosed positive displacement mechanism according to claim 7, wherein said electromagnetic stator is included in the mechanism and includes a plurality of conducting windings wound on respective polar expansions.

9. The enclosed positive displacement mechanism according to claim 8, wherein said polar expansions are arranged to be coupled by radial interference with respective external grooves included in said body.

10. The enclosed positive displacement mechanism according to claim 8, including an electronic control unit connected to the conducting windings and arranged to manage/adjust the rotation speed of said rotor or each said rotor.

11. Work-absorbing or work-producing fluid machine, including an enclosed positive displacement mechanism comprising:

a body defining a cylindrical cavity with an internal side surface and having at least a first and a second inlet port and at least a first and a second outlet port intended to allow a fluid to inflow into said cylindrical cavity and to allow said fluid to outflow from said cavity, respectively;

a rotor mounted in said body so as to be rotatable about a main or revolution axis;

an orbiting piston, which is located in said cavity, is mounted on said rotor so as to be rotatable about a secondary or rotation axis eccentric with respect to said main axis and is arranged to roll on the internal side surface of said cavity; and a single vane slidable in said orbiting piston, said vane is mounted in a peripheral portion of said body located between one of said inlet ports and one of said outlet ports, contiguous to said one of the inlet ports, so as to oscillate in use, and is mounted in said body so as to pass through said orbiting piston and is guided with a free end of said vane in contact with the internal side surface of said cavity, and wherein an arc-shaped sector, which delimits the oscillation of said vane and on which the free end of said vane is arranged to tangentially slide during an entire oscillation, is hollowed out of the internal side surface of said cavity.

12. The work-absorbing or work-producing fluid machine as claimed in claim 11, wherein said mechanism comprises in addition a further rotor located axially in opposition to said rotor with respect to said vane and rotatable about said main axis and said orbiting piston is mounted between said rotors so as to orbit, in use, around said main axis and to be rotatable about the secondary axis.

13. The work-absorbing or work-producing fluid machine as claimed in claim 12, wherein said rotor or each said rotor includes a plurality of permanent magnets located on the periphery of the rotor and arranged to magnetically interact with an electromagnetic stator and wherein said electromagnetic stator is included in the mechanism and includes a plurality of conducting windings wound on respective polar expansions.

* * * * *